US010106352B2

(12) United States Patent
Gillier et al.

(10) Patent No.: US 10,106,352 B2
(45) Date of Patent: Oct. 23, 2018

(54) DOUBLE FEED RECOVERY AND PROCESSING

(71) Applicant: NCR Corporation, Duluth, GA (US)

(72) Inventors: Jason Michael Gillier, Waterloo (CA); Benjamin T. Widsten, Kitchener (CA)

(73) Assignee: NCR Corporation, Atlanta, GA (US)

( * ) Notice: Subject to any disclaimer, the term of this patent is extended or adjusted under 35 U.S.C. 154(b) by 0 days.

(21) Appl. No.: 15/221,132

(22) Filed: Jul. 27, 2016

(65) Prior Publication Data

US 2018/0029814 A1 Feb. 1, 2018

(51) Int. Cl.

| | |
|---|---|
| ***B65H 7/12*** | (2006.01) |
| ***B65H 3/52*** | (2006.01) |
| ***B65H 5/06*** | (2006.01) |

(52) U.S. Cl.

CPC ..... *B65H 7/125* (2013.01); *B65H 3/5261* (2013.01); *B65H 3/5284* (2013.01); *B65H 5/062* (2013.01); *B65H 7/12* (2013.01); *B65H 2511/524* (2013.01); *B65H 2513/41* (2013.01); *B65H 2513/53* (2013.01); *B65H 2701/1912* (2013.01)

(58) Field of Classification Search

CPC .... B65H 7/125; B65H 7/12; B65H 2511/524; B65H 3/5261

See application file for complete search history.

(56) References Cited

U.S. PATENT DOCUMENTS

| | | | | |
|---|---|---|---|---|
| 5,029,837 | A * | 7/1991 | Uchiyama | B65H 7/12 271/110 |
| 5,384,631 | A * | 1/1995 | Matsunami | B65H 3/06 271/110 |
| 6,234,470 | B1 * | 5/2001 | Okitsu | B65H 3/5261 271/10.11 |
| 7,905,484 | B2 * | 3/2011 | Komuro | B65H 3/0684 271/10.03 |
| 8,678,372 | B2 * | 3/2014 | Yasukawa | B65H 7/12 271/10.09 |
| 2008/0290584 | A1 * | 11/2008 | Dunn | B65H 7/12 271/10.02 |
| 2017/0210582 | A1 * | 7/2017 | Okano | B65H 7/125 |

* cited by examiner

*Primary Examiner* — Luis A Gonzalez

(74) *Attorney, Agent, or Firm* — Schwegman, Lundberg & Woessner

(57) ABSTRACT

A media separator module of a valuable media depository is selectively controlled to progressively and selectively activate drives for double feed media recovery processing when two items of media are detected within the media separator module.

6 Claims, 8 Drawing Sheets

DOUBLE FEED RECOVERY AND PROCESSING

BACKGROUND

Media handing devices that process multiple document bunches must separate the documents for individual processing downstream within the media handling devices. A media separator is a component of the media handling devices. Typically, the media separator uses an ultrasonic sensor for detecting any overlapping documents.

The ultrasonic sensor reports when a detection is made as to whether the ultrasonic sensor detects: i) a clear condition, ii) a single condition, or iii) a double condition. A clear condition indicates that no document is detected by the ultrasonic sensor. A single condition indicates that one document is detected by the ultrasonic sensor. A double condition indicates one or multiple documents are detected by the ultrasonic sensor (a double condition can be two overlapping documents or one folded document).

A double feed recovery is performed by the media separator to separate any detected overlapping documents within the media separator (a double condition). The entire bunch of documents is backed up within the media separator and the bunch is attempted to be re-fed in a subsequent iteration. This cycle repeats until a document separates or a predefined number of retries is exhausted.

Traditional double feed recovery processing makes little progress separating overlapping documents with reach retry. So, the traditional processing (document throughput within the media separator) is very inefficient and slow and often takes many attempts to separate documents in a bunch. Furthermore, the retry processing is overly aggressive in nature for some documents that just require a little assistance to separate. This over aggressive approach can cause limp or worn documents to buckle, crumple, and jam within the media separator resulting in a fatal fault. Still further, and often, the retry processing is exhausted before the document separates resulting in a fault and the documents are returned to the customer. The customer can detect no apparent reason for the documents being returned and there is nothing the customer can do in assisting the media separator for successfully accepting and processing the documents.

Thus, the traditional slow double feed recovery, frequent inconvenient and unnecessary media separator faults, and returned documents to the customer can cause support confusion and poor customer satisfaction with the enterprise associated with the media handling device having the media separator.

SUMMARY

In various embodiments, methods and a system for double feed media recovery and processing within a valuable media depository are provided.

According to an embodiment, a method for double feed media recovery and processing is presented. Specifically, and in one embodiment, a double media condition is detected within a media separator module for two items of media. Next, opposing drives of the media separator module are selectively and progressively controlled for separating the two items into a top item and a bottom item and ejecting the top item from the media separator module in response to detection of the double media condition.

DETAILED DESCRIPTION

Figure 1A:
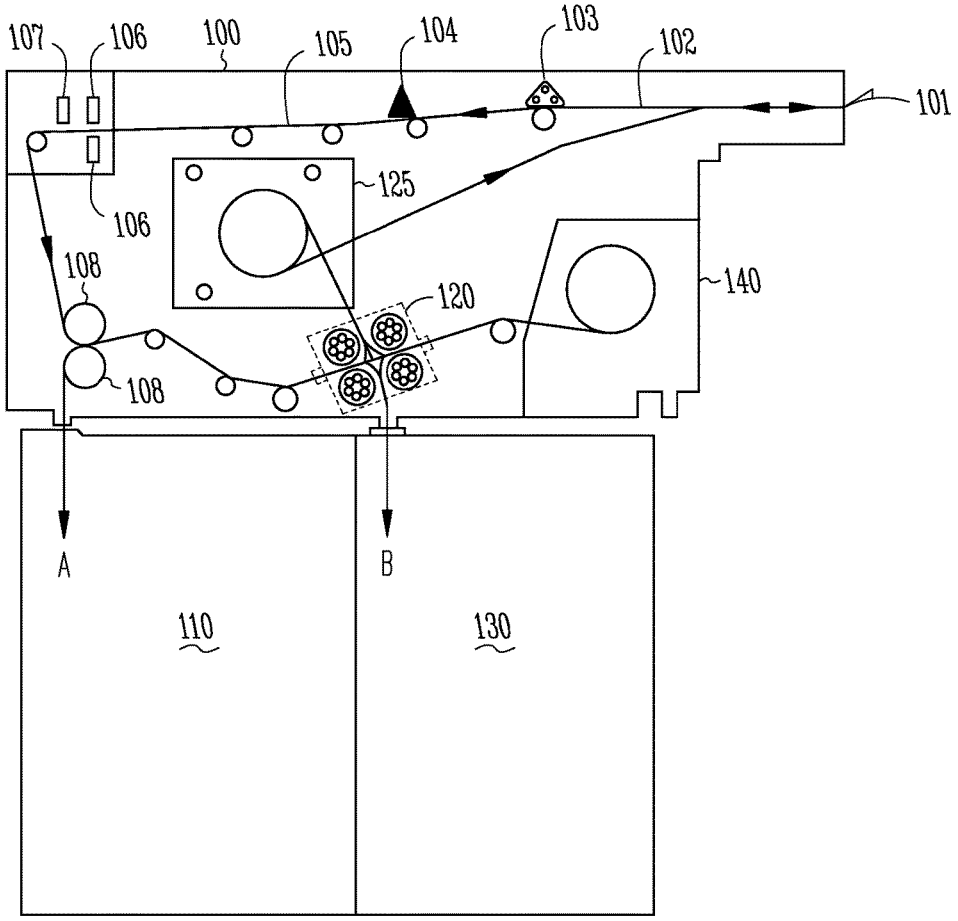
FIG. 1A is a diagram depicting a deposit module of a Self-Service Terminal (SST) having a media separator module, according to an example embodiment.

FIG. 1A is a diagram depicting a one-sided view of a valuable media depository 100, according to an example embodiment (also referred to as a deposit module). It is to be noted that the valuable media depository is shown with only those components relevant to understanding what has been added and modified to a conventional depository for purposes of providing double feed media (document) recovery and processing within the depository 100.

The depository 100 is suitable for use within an Automated Teller Machine (ATM), which can be utilized to process deposited banknotes and checks (valuable media as a mixed bunch if desired). The deposit module 100 has an access mouth 101 (media or document infeed) through which incoming checks and/or banknotes are deposited or outgoing checks and/or banknotes are dispensed. This mouth 101 is aligned with an infeed aperture in the fascia of the ATM in which the depository 100 is located, which thus provides an input/output slot to the customer. A bunch (stack) of one or more items (valuable media) is input or output. Incoming checks and/or banknotes follow a first transport path 102 away from the mouth 101 in a substantially horizontal direction from right to left shown in the FIG. 1A. They then pass through a novel separator module 103 (discussed in detail below with reference to the FIGS. 1B-1I, 2, and 3) and from the separator 103 to a deskew module 104 along another pathway portion 105, which is also substantially horizontal and right to left. The items are now de-skewed and aligned for reading by imaging cameras 106 and a Magnetic Ink Character Recognition (MICR) reader 107.

Items are then directed substantially vertically downwards to a point between two nip rollers 108. These nip rollers cooperate and are rotated in opposite directions with respect to each other to either draw deposited checks and/or banknotes inwards (and urge those checks and/or banknotes towards the right hand side in the FIG. 1A), or during another mode of operation, the rollers can be rotated in an opposite fashion to direct processed checks and/or banknotes downwards in the direction shown by arrow A in the FIG. 1A into a check or banknote bin 110. Incoming checks and/or banknotes, which are moved by the nip rollers 108 towards the right, enter a diverter mechanism 120. The diverter mechanism 120 can either divert the incoming checks and/or banknotes upwards (in the FIG. 1A) into a re-buncher unit 125, or downwards in the direction of arrow B in the FIG. 1A into a cash bin 130, or to the right hand side shown in the FIG. 1A into an escrow 140. Items of media from the escrow 140 can selectively be removed from the drum and re-processed after temporary storage. This results in items of media moving from the escrow 140 towards the left hand side of the FIG. 1A where again they will enter the diverter mechanism 120. The diverter mechanism 120 can be utilized to allow the transported checks (a type of valuable media/document) and/or banknotes (another type of valuable media/document) to move substantially unimpeded towards the left hand side and thus the nip rollers 108 or upwards towards the re-buncher 125. Currency notes from the escrow can be directed to the re-buncher 125 or downwards into the banknote bin 130.

As used herein, the phrase "valuable media" refers to media of value, such as currency, coupons, checks, negotiable instruments, value tickets, and the like.

For purposes of the discussions that follow with respect to the FIGS. 1A-1I, "valuable media" is referred to as currency and the "valuable media depository" is referred to as a "depository." Additionally, valuable media may be referred to as a "document" herein.

Figure 1B:
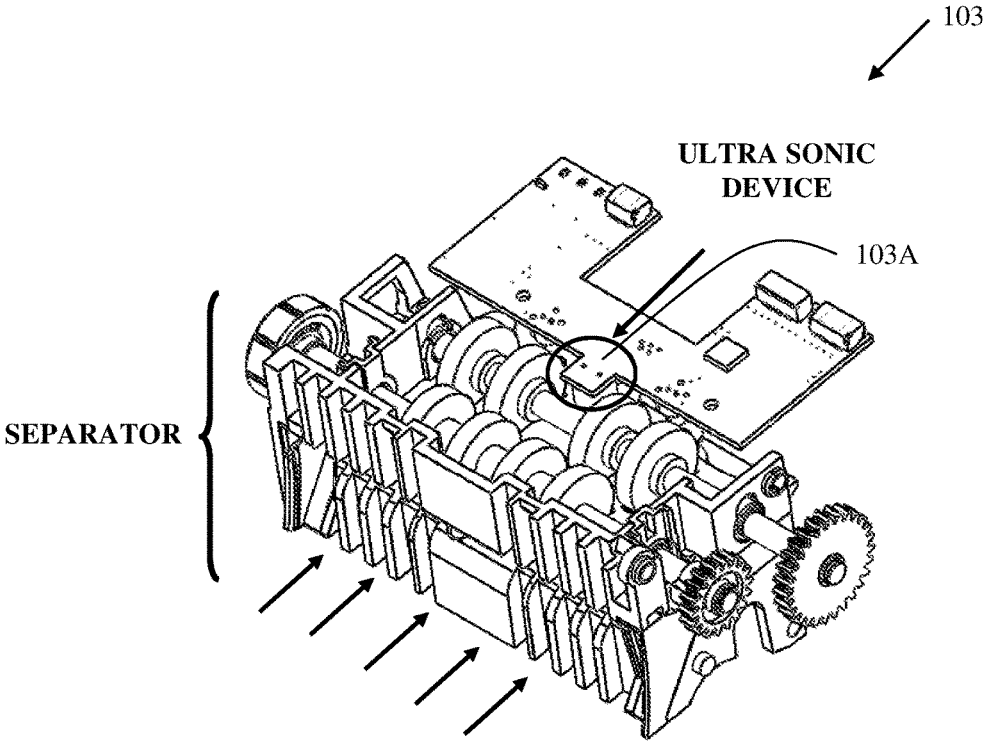
FIG. 1B is a diagram depicting a media separator module from a top-bottom perspective, according to an example embodiment.

FIG. 1B is a diagram depicting a media separator module 103 from a top-bottom perspective, according to an example embodiment.

Only those components of the media separator module 103 that are necessary for understanding the teachings presented herein are labeled in the FIGS. 1B-1I that follow.

Visible in the top-to-bottom perspective of the media separator module 103 in the FIG. 1B is a top (from the perspective of the document's travel through the media separator module 103) or a first ultrasonic sensor 103A.

Figure 1C:
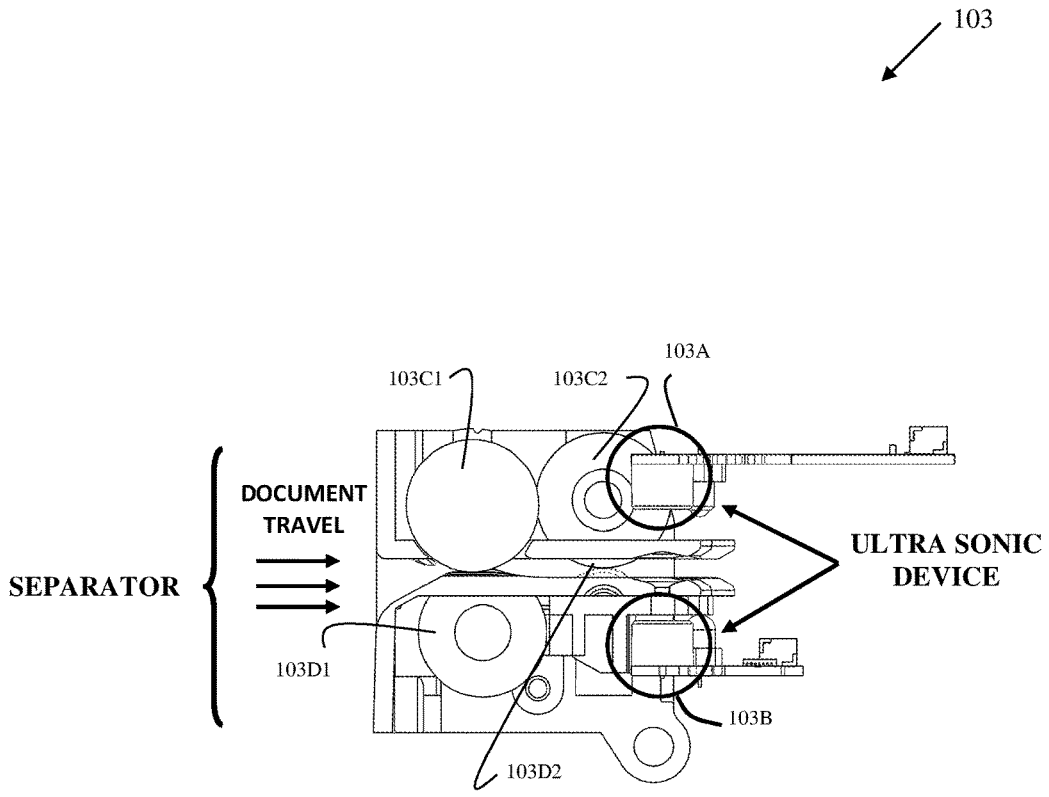
FIG. 1C is a diagram depicting a cross-section perspective of a media separator module, according to an example embodiment.
Figure 1D:
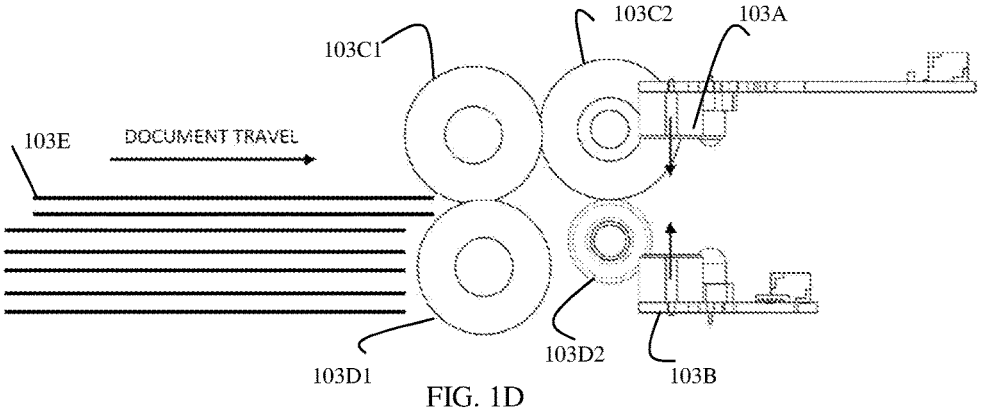
FIG. 1D is a diagram depicting an entry of two documents into the media separator module, according to an example embodiment.
Figure 1E:
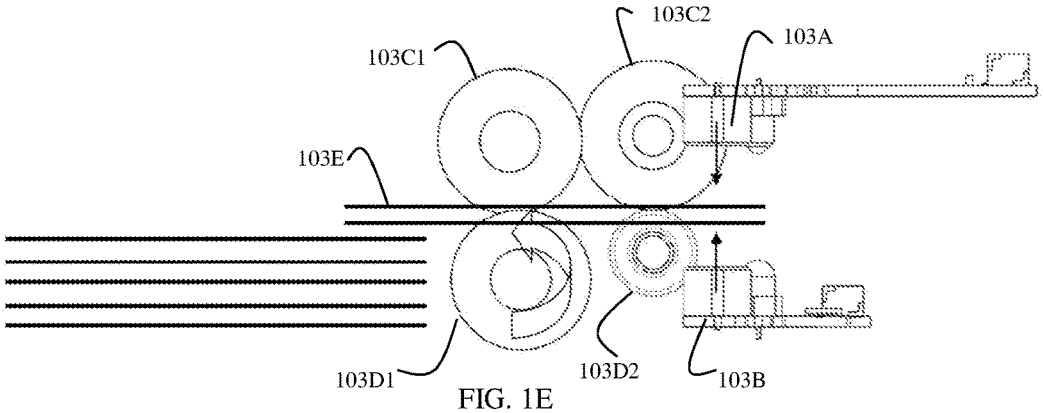
FIG. 1E is a diagram depicting a double condition with two documents within a media separator module, according to an example embodiment.
Figure 1F:
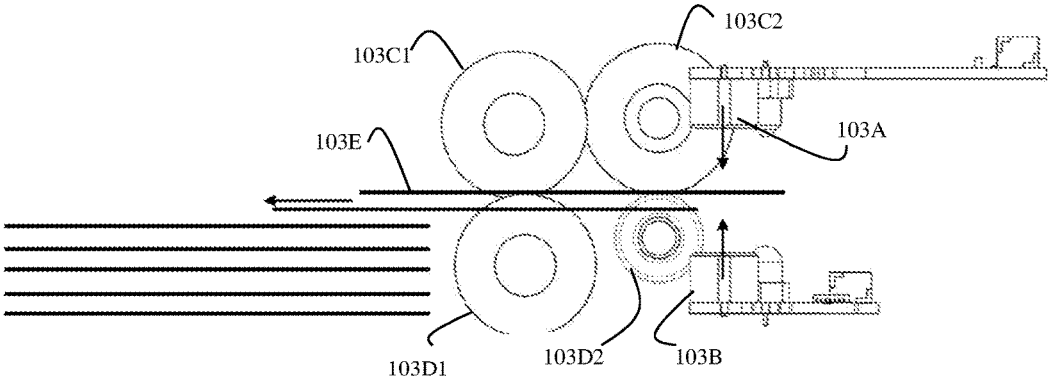
FIG. 1F is a diagram depicting successful separation of the media following a double condition within a media separator module, according to an example embodiment.
Figure 1G:
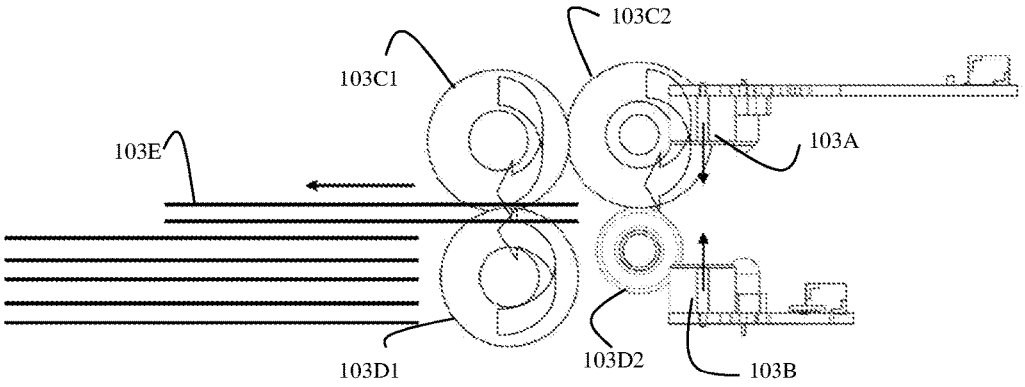
FIG. 1G is a diagram depicting a continuing double condition following an initial attempt to separate the media within a media separator module, according to an example embodiment.
Figure 1H:
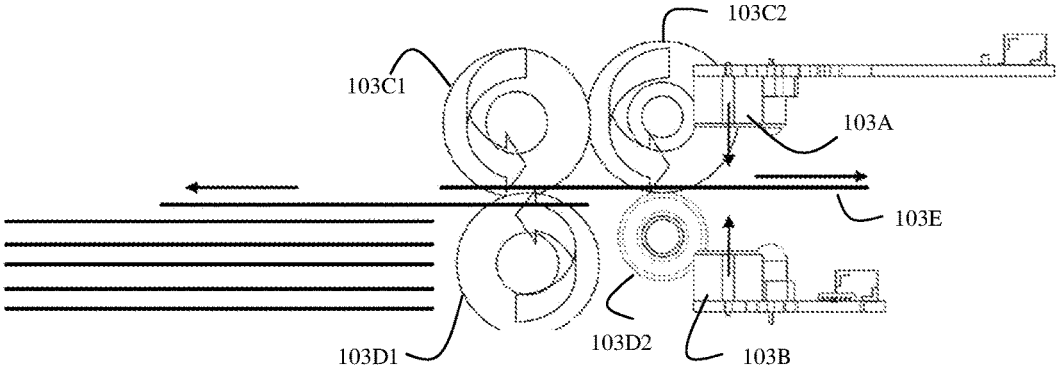
FIG. 1H is a diagram depicting successful separation of the media for a second attempt to separate the media within a media separator.
Figure 1I:
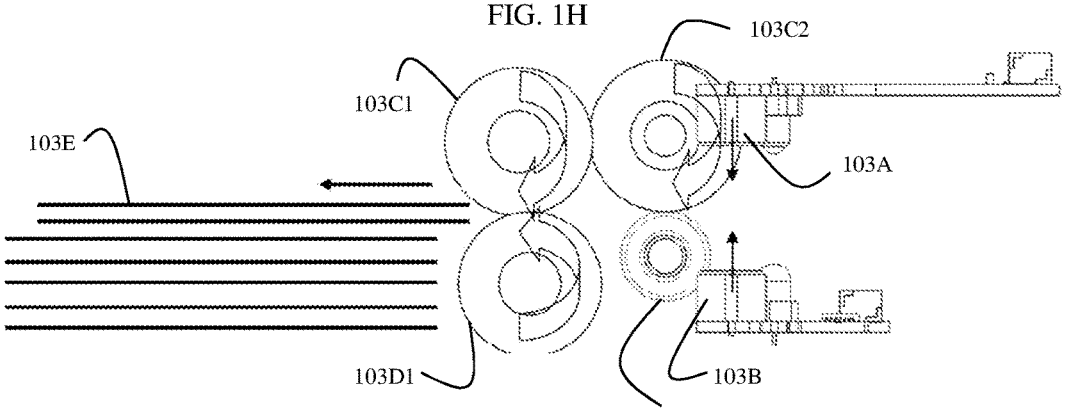
FIG. 1I is a diagram depicting restaging the media at an entry point into the media separator module when a double condition fails to be resolved, according to an example embodiment.

FIG. 1C is a diagram depicting a cross-section perspective of media separator module 103, according to an example embodiment.

Visible in the cross-section perspective of the media separator module in the FIG. 1C is: i) the first (top) ultrasonic sensor 103A which opposes a second (bottom) ultrasonic sensor 103B (the document passes through and between the first (top) ultrasonic sensor 103A and the second (bottom) ultrasonic sensor 103B, and ii) transport drives including a pair of adjacent upper (top) drives (rollers) 103C1 (advance roller) and 103C2 (exit rollers) which oppose a pair of adjacent lower (bottom) drives 103D1 and 103D2 (the document is urged along a path of travel between the two pairs of transport drives (103C1, 103C2, 103D1, and 103D2) and the ultrasonic sensors 103A and 103B.

During conventional document (media) double feed recovery processing, a conventional separator module would detect one of three conditions reported from the conventional ultrasonic sensors. A clear condition indicating that there is no document detected between the ultrasonic sensors; a single condition indicating that a single document is detected between the ultrasonic sensors; and double condition indicating one or multiple documents are detected between the ultrasonic sensors. The conventional separator module pauses for a small configured amount of time when the double condition is detected and after such pause takes another reading from the ultrasonic sensors to see if the double condition has resolved itself. When the double condition is not resolved, the conventional separator module performs a double feed recovery attempt to separate the potential multiple documents within the separator module through activation of the conventional transport drives. After a configured amount of unsuccessful attempts to automatically separate the multiple documents, the conventional separator module ejects the documents from the conventional separator module. Thus, the conventional separator module has three modes of operation: a normal mode (where no dual document processing is needed), a dual recovery mode (where dual documents are detected and separation processing is performed, and an ejection mode (where documents after having attempted the dual recovery processing fail to separate and the documents are ejected back out an entry point in the conventional separator module).

As will be discussed more completely herein and below, the media separator module 103 is configured to selectively activate various combinations of the transport drives (103C1-C2 and 103D1-D2) when a double condition is detected within the media separator module 103 for novel double feed media recovery processing. The one or more transport drives (103C1, 103C2, 103D1, and/or 103D2) are selectively activated and selective rotated in directions that are different from that which has been done conventionally for document double feed recovery in response to the double feed media recovery; thereby, providing novel additional modes of operation for the media separator module 103 from that which has been conventionally done.

Novel Double Feed Recovery and Processing

As a document 103E is urged through the media separator module 103, the ultrasonic sensors 103A and 103B provide readings for the document. The start of the document 103E is noted through ultrasonic sensor readings and readings are reported as the document travels through the media separator module 103. The ultrasonic sensors 103A and 103B report conditions for the document 103E as the document 103E is being processed (from a bunch of media items) through the media separator module 103 at different selective locations.

The ultrasonic sensors 103A and 13B provide readings that indicate one of three conditions for the document 103A passing between the sensors 103A and 103B: a clear condition, a blockage with a single condition (single document sensed), and a blockage with a double condition (potentially a single document with a type of fold or potential two documents that have not been properly separated).

Processing proceeds as follows:

1.) Feeding of documents from the bunch is attempted until an ultrasonic sensors 103A and 103B report a single condition, a double condition, or a time out occurs (double feed recovery processing reaches a predefined limit for a number of attempts). If the sensors 103A and 1038 report (through readings) a single condition, the top document 103E is allowed to progress through the media separator module 103 through an exit point and continues along the transport pathway 105 within the media depository 100. If a time out occurs a separate algorithm is enacted for feed retries. Initial feeding of a bunch of documents into the media separator is shown in the FIG. 1D.

2.) If at any time during document feed the ultrasonic sensors 103A and 1038 report a double condition, the transport drives (103C1-C2) are stopped. A double condition is shown in the FIG. 1E.

3.) Optionally, a tiltenator pressure pinch is decreased from its existing pressure setting and saved for future feed processing (as described below). This allows overlapping documents to move in reverse back into the original fed bunch of media (documents).

4.) The retard roller 103D1 continues to drive in a reverse direction (opposite from the depicted document travel direction in the FIG. 1D) to attempt move a bottom document (document in contact with the retard roller 103D1) back towards the bunch of documents (entry point into media separator module 103). This is shown in the FIG. 1E.

5.) A small (configurable) waiting period is observed to see if the double condition clears after (4) has been allowed to drive the retard roller 103D1 a short distance with the advance rollers 103C1-C2 stopped. After this waiting period passes, the following sub-processing occurs:

a.) If the double condition is observed as being cleared (through readings reported from the ultrasonic sensors 103A and 103B), the sub-processing is terminated and the processing resumes at (6) below. This is shown in the FIG. 1F.

b.) If the double condition remains after the waiting period passes, the advance (103C1) and exit (103C2) rollers are driven in a reverse direction (from the original document direction of travel through the media separator) for a short (configurable) distance in cooperation with the retard roller (103D1) to position the document 103E just in front of the exit roller (103C2). A second small (configurable) time period is observed with the advance (103C1) and the exit (1032) rollers driven in a forward direction while the retard roller 103D1 is driven in the reverse direction to determine if the double condition clears. This is shown in the FIG. 1H.

c.) If the double condition has cleared after the small (configurable time period is observed), the sub-processing exits to the processing discussed below at (6). If the double condition does not clear, the documents are reversed out of the media separator 103 back through the entry point and staged at the front (entry point) of the media separator 103 (shown in the FIG. 11) and a re-feed is attempted back at (1).

6.) For any of the above processing, when the ultrasonic sensors 103A and 103B stop reporting a double condition, the current processing step being performed when the double condition is no longer being reported is continued for a small (configurable) time period in order to move the overlapping documents a small (configurable) distance away from the ultrasonic sensors 103A and 1038. This is done so the double condition is not reported instantly when the media separator 103 starts again (normal separation mode) and gives the media separator 103 time to separate the overlapping documents. When the media separator 103 is started in normal mode, optionally, the saved tiltenator from (3) is restored so that the normal mode of separation instantly begins with the correct pinch pressure and position.

This novel processing provides a progressive double feed recovery technique for gradually persuading separation of the overlapping documents at each processing stage; and which progressively becomes more and more aggressive. This progressive nature is much less disruptive to the bunch of documents and much gentler with limp/worn/damaged documents than convention approaches. Moreover, each subsequent processing stage has less and less overlap to deal with so the overlapping documents separate sooner than conventional approaches; thereby, requiring fewer processing stages and fewer feed retires than conventional approaches. As such, the double feed media recovery processing discussed herein improves the operational efficiency and effectiveness from that which has been conventionally done.

The double feed media recovery processing discussed herein provides:

1) Improved media feed processing throughput through a media separator module 103.
2) Reduced inconvenient faults and reduced potential fatal/critical faults within the media separator module 103.
3) Improved range of media quality and operational environmental conditions that the media separator module 103 can successfully process; resulting in the media separator module 103 staying in service longer without disruption and increasing the expected service life of the media separator module 103.
4) Improved customer satisfaction when interacting with the media depository 100.
5) Improved integration within the media separator module 103 because the processing can be implement as a firmware upgrade to the media separator module 103 without requiring new mechanical componentry for implementation of the processing described herein.

These and other embodiments are now discussed with reference to the FIGS. 2-4.

Figure 2:
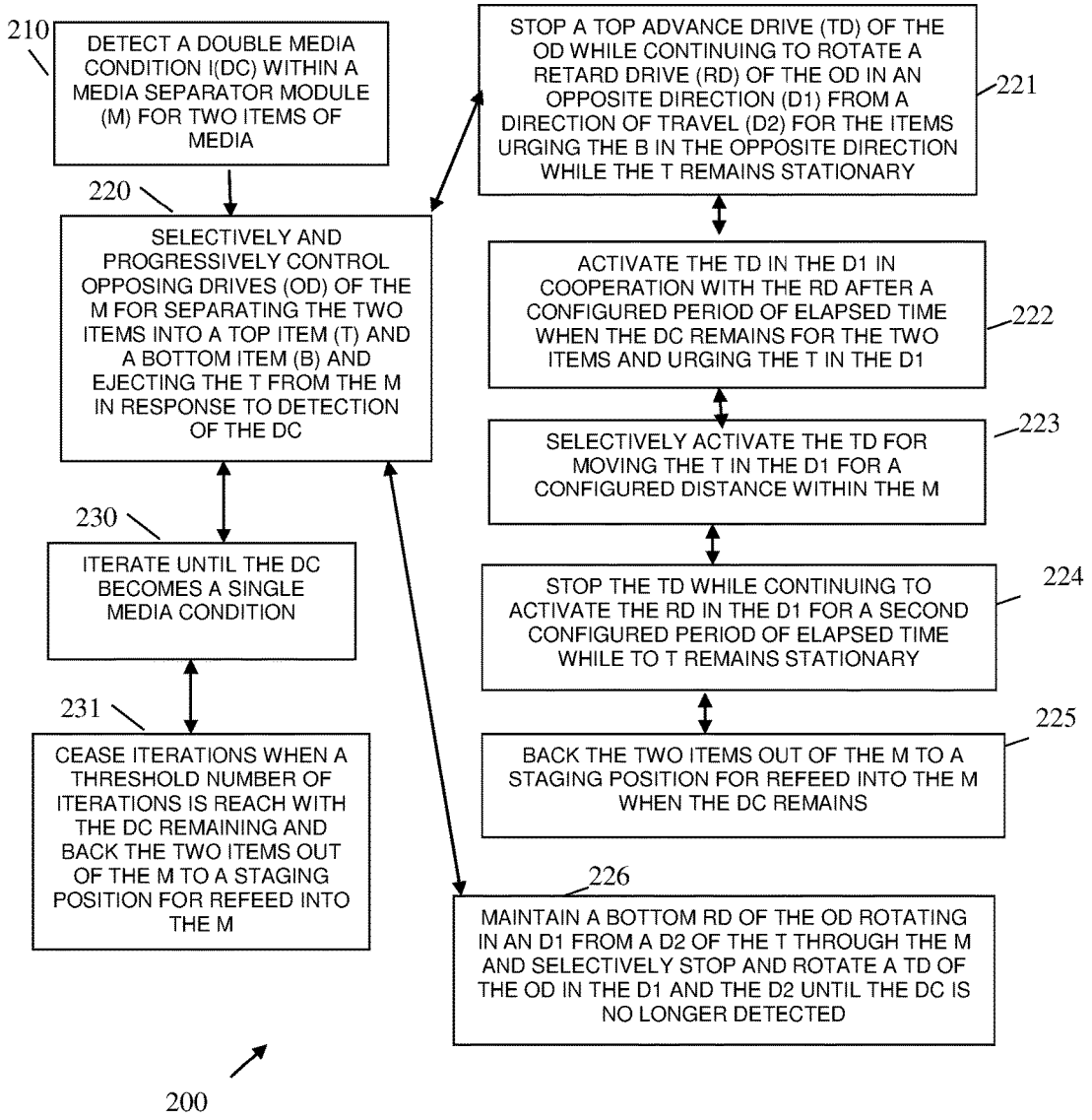
FIG. 2 is a diagram of a method for double feed media recovery and processing within a media separator module, according to an example embodiment.

FIG. 2 is a diagram of a method 200 for double feed media recovery and processing within a media separator module, according to an example embodiment. The method 200 when processed controls operation for a media separator module integrated into a valuable media depository. The method 200 is implemented as executable instructions representing one or more software modules referred to as a "double feed recovery controller." The instructions reside in a non-transitory computer-readable medium and are executed by one or more processors of the valuable media depository.

In an embodiment, the double feed recovery controller is executed by one or more processors of the valuable media depository 100.

In an embodiment, the media depository is a deposit module.

In an embodiment, the media depository is a recycler module.

In an embodiment, the media depository is a peripheral device integrated into an SST. In an embodiment, the SST is an ATM. In an embodiment, the SST is a kiosk.

In an embodiment, the media depository is a peripheral device integrated into a Point-Of-Sale (POS) terminal.

In an embodiment, the double feed recovery controller is a controller implemented within firmware of a media depository and executed by one or more processors and memory associated with the controller to perform the processing discussed above with the FIGS. 1B-1I.

At 210, the double feed recovery controller detects a double media condition within a media separator module. As discussed above, this is done when two or more items of media are detected as overlapping within the media separator module. One technique for detection is a pair of opposing ultrasonic sensors 103A and 103B (presented above).

At 220, the double feed recovery controller selectively and progressively controls opposing drives of the media separator module for separating the two items into a top item and a bottom item and ejecting the top item from the media separator module in response to detection of the double media condition.

According to an embodiment, at 221, the double feed recovery controller stops an advance drive of the opposing drives while continuing to rotate a retard drive of the opposing drives in an opposite direction from a direction of travel for the items urging the bottom item in the opposite direction while the top item remains stationary.

In an embodiment of 221 and at 222, the double feed recovery controller activates the advance drive in the opposite direction in cooperation with the retard drive after a configured period of elapsed time when the double media condition remains for the two items and urging the top item in the opposite direction.

In an embodiment of 222 and at 223, the double feed recovery controller selectively activates the advance drive for moving the top item in the opposite direction for a configured distance within the media separator module.

In an embodiment of 223 and at 224, the double feed recovery controller stops the advance drive while continuing to activate the retard drive in the opposite direction for a second configured period of elapsed time while the top item remains stationary.

In an embodiment of 224 and at 225, the double feed recovery controller back the two items out of the media separator module to a staging position for refeed into the media separator module when the double media condition remains.

According to an embodiment, at 226, the double feed recovery controller maintains a bottom retard drive of the opposing drives rotating in an opposite direction from a direction of travel of the items through the media separator module and selectively stopping and rotating a top drive of the opposing drives in the opposite direction until the double media condition is no longer detected.

In an embodiment, at 230, the double feed recovery controller iterates the processing at 220 until the double media condition becomes a single media condition.

In an embodiment of 230 and at 231, the double feed recovery controller ceases or stops iterations when a threshold number of iterations is reached with the double media condition remaining and back the two items out of the media separator module to a staging position for refeed into the media separator module.

Figure 3:
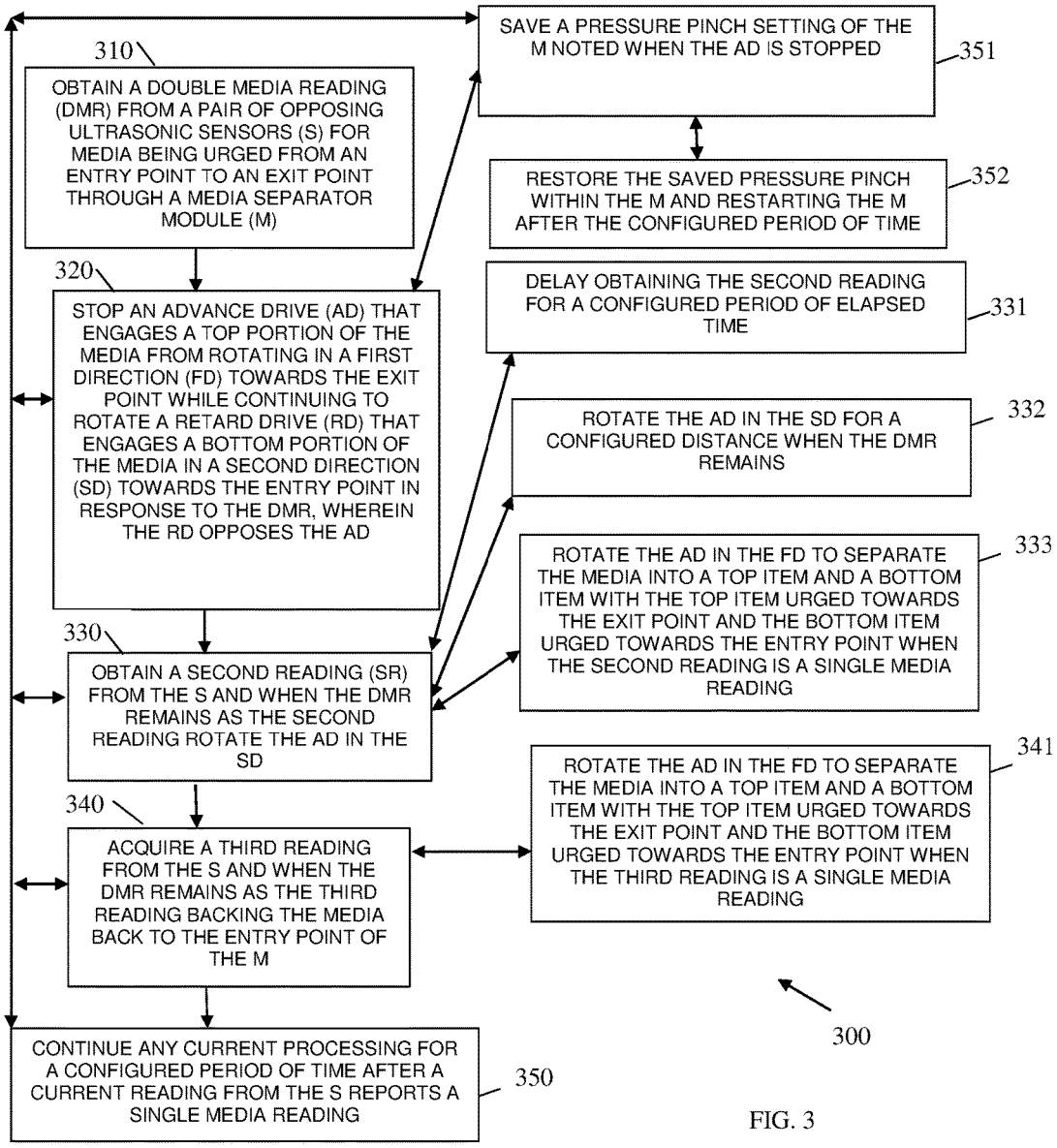
FIG. 3 is a diagram of another method for double feed media recovery and processing within a media separator module, according to an example embodiment.

FIG. 3 is a diagram of another method 300 for double feed media recovery and processing within a media separator module, according to an example embodiment. The method 200 when processed controls double feed media recovery processing within a valuable media depository. The method 200 is implemented as executed instructions representing one or more software modules referred to as a double feed recovery manager. The instructions reside in a non-transitory computer-readable medium and are executed by one or more processors of the valuable media depository.

In an embodiment, the double feed recovery manager is executed by one or more processors of the valuable media depository 100.

In an embodiment, the media depository is a deposit module.

In an embodiment, the media depository is a recycler module.

In an embodiment, the media depository is a peripheral device integrated into an SST. In an embodiment, the SST is an ATM. In an embodiment, the SST is a kiosk.

In an embodiment, the media depository is a peripheral device integrated into a Point-Of-Sale (POS) terminal.

In an embodiment, the double feed recovery manager implements the processing discussed above with the FIGS. 1A-1I and 2.

In an embodiment, the double feed recovery manager presents another and in some ways enhance perspective of the processing depicted in the method 200 (presented above with the discussion of the FIG. 2 and the double feed recovery controller).

At 310, the double feed recovery manager obtains a double media reading from a pair of opposing ultrasonic sensors for media being urged from an entry point to an exit point through the media separator module. In an embodiment, the ultrasonic sensors are 103A and 1038.

At 320, the double feed recovery manager stops an advance drive that engages a top portion of the media from rotating in a first direction towards the exit point while continuing to rotate a retard drive that engages a bottom portion of the media in a second direction towards the entry point in response to the double media reading. The retard drive opposed the advance drive. In an embodiment, the retard drive is 104D1 and/or 104D2; the advance drive is 104C1 and/or 104C2.

At 330, the double feed recovery manager obtains a second reading from the ultrasonic sensors and when the double media reading remains as the second reading, rotate the advance drive in the second direction (towards the entry point of the media into the media separator module).

In an embodiment, at 331, the double feed recovery manager delays obtaining the second reading for a configured period of elapsed time.

In an embodiment, at 332, the double feed recovery manager rotates the advance drive in the second direction (towards the entry point of the media into the media separator) for a configured distance when the double media reading remains.

In an embodiment, at 333, the double feed recovery manager rotates the advance drive in the first direction (towards the exit point) to separate the media into a top item and a bottom item with the top item urged towards the exit point and the bottom item urged towards the entry point when the second reading is a single media item.

At 340, the double feed recovery manager acquires a third reading from the ultrasonic sensors and when the double media condition remains as the third reading backing the media back to the entry point of the media separator module.

In an embodiment, at 341, the double feed recovery manager rotates the advance drive in the first direction (toward the exit point) to separate the media into a top item and a bottom item with the top item urged towards the exit point and the bottom item urged towards the entry point when the third reading is a single media reading.

In an embodiment, at 350, the double feed recovery manager continues any of the processing at 320, 330, and 340 for a configured period of time after a current reading from the ultrasonic sensors reports a single media reading. This was discussed above with the discussion of the FIGS. 1A-1I.

In an embodiment of 350 and 320, at 351, the double feed recovery manager saves a pressure pinch setting of the media separator module when the advance drive is stopped.

In an embodiment of 351, at 352, the double feed recovery manager restores the saved pressure pinch within the media separator module and restarts the media separator module after a configured period of time.

Figure 4:
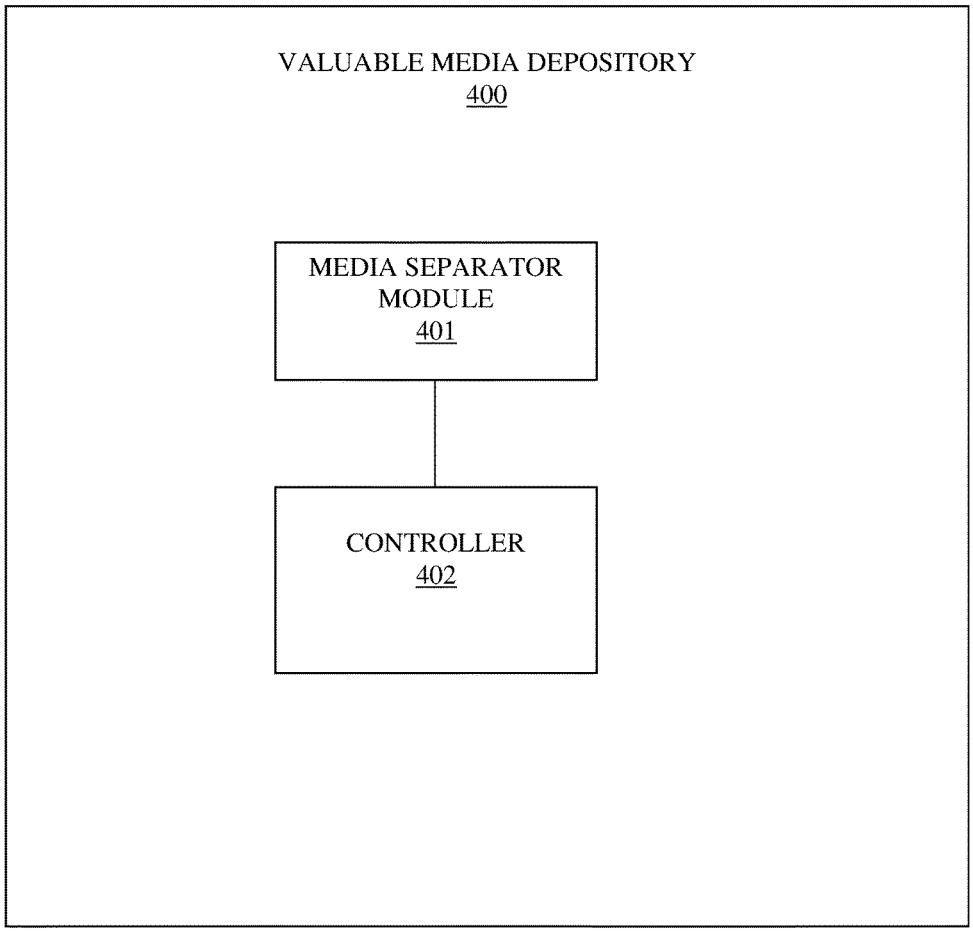
FIG. 4 is a diagram of a valuable media depository, according to an example embodiment.

FIG. 4 is a media depository 400 with a media separator module, according to an example embodiment. The valuable media depository 400 processes valuable media and includes a variety of mechanical, electrical, and software/firmware components, some of which were discussed above with reference to the FIGS. 1A-1I and the FIGS. 2-3.

In an embodiment, the valuable media depository 400 is a deposit module.

In an embodiment, the valuable media depository 400 is a recycler module.

In an embodiment, the valuable media depository 400 is the depository 100.

In an embodiment, the valuable media depository 400 is the depository that performs: any or, some combination of, or all of the processing discussed above in the FIGS. 1A-1I and 2-3.

In an embodiment, the valuable media depository 400 is a peripheral device integrated into an SST. In an embodiment, the SST is an ATM. In an embodiment, the SST is a kiosk.

In an embodiment, the valuable media depository 400 is a peripheral device integrated into a Point-Of-Sale (POS) terminal.

The valuable media depository 400 includes a media separator module 401 including a controller 402 operable to control the media separator module 401.

The controller 402 is configured to selectively and progressively (gradually and in a predefined sequence based on readings from the ultrasonic sensors 103A and 103B) control rotation of an advance drive and an opposing retard drive when two items or media are overlapping within the media separator module 401 to urge a top item to separate from the two items and move in a direction towards an exit point of the media separator module 401 while a bottom item from the two items is separated and urged towards an entry point of the media separator module 401.

In an embodiment, the controller 402 is further configured to continue to rotate the retard drive in the direction of the exit point while the advance drive is selectively: i) stopped, ii) started, iii) rotated in the direction towards the exit point, and iv) rotated in the direction of the entry point.

In an embodiment, the controller 402 drives the electromechanical components of the media separator module 103 as discussed in the FIGS. 1B-1I and the FIGS. 2-3.

In an embodiment, the controller 402 is the controller discussed above with reference to the FIGS. 1A-1I and/or 2-3.

In an embodiment, the controller 402 is the method 200 of the FIG. 2.

In an embodiment, the controller 402 is the method 300 of the FIG. 3.

In an embodiment, the controller 402 performs all or some combination of the processing performed by: the processing discussed above with reference to the FIGS. 1A-1I, the method 200, and the method 300.

In an embodiment, the controller 402 is further configured to perform a configured number of processing iterations for the double feed recovery processing within the media separator module 401 after which the controller 402 is configured to eject the item from the media separator module 401 when the item is unsuccessfully processed through the media separator module 401.

The above description is illustrative, and not restrictive. Many other embodiments will be apparent to those of skill in the art upon reviewing the above description. The scope of embodiments should therefore be determined with reference to the appended claims, along with the full scope of equivalents to which such claims are entitled.

In the foregoing description of the embodiments, various features are grouped together in a single embodiment for the purpose of streamlining the disclosure. This method of disclosure is not to be interpreted as reflecting that the claimed embodiments have more features than are expressly recited in each claim. Rather, as the following claims reflect, inventive subject matter lies in less than all features of a single disclosed embodiment. Thus the following claims are hereby incorporated into the Description of the Embodiments, with each claim standing on its own as a separate exemplary embodiment.

The invention claimed is:

1. A method, comprising:

(i) obtaining, by executable instructions that represent a double feed media recovery manager, the executable instructions execute on at least one processor of a media separator module, a double media reading from a pair of opposing ultrasonic sensors for media being urged from an entry point to an exit point through the media separator module;

(ii) stopping, by the double feed recovery manager, an advance drive that engages a top portion of the media from rotating in a first direction towards the exit point while continuing to rotate a retard drive that engages a bottom portion of the media in a second direction towards the entry point in response to the double media reading, wherein the retard drive opposes the advance drive, wherein (ii) further includes saving, by the double feed recovery manager, a pressure pinch setting of the media separator module noted when the advance drive is stopped in an non-transitory computer-readable medium;

(iii) obtaining, by the double feed recovery manager, a second reading from the ultrasonic sensors and when the double media reading remains as the second reading rotating the advance drive in the second direction;

(iv) acquiring, by the double feed recovery manager, a third reading from the ultrasonic sensors and when the double media reading remains as the third reading backing the media back to the entry point of the media separator module; and continuing any current processing at (ii)-(iv), by the double feed recovery manager, for a configured period of time after a current reading from the ultrasonic sensors reports a single media reading;

wherein predefined time delays between the double media reading, the second reading, and the third reading control (i)-(iv).

2. The method of claim 1, wherein (iii) further includes delaying, by the double feed recovery manager, the obtaining of the second reading for a configured period of elapsed time.

3. The method of claim 1, wherein (iii) further includes rotating, by the double feed recovery manager, the advance drive in the second direction for a configured distance when the double media reading remains.

4. The method of claim 1, wherein (iii) further includes rotating, by the double feed recovery manager, the advance drive in the first direction to separate the media into a top item and a bottom item with the top item urged towards the exit point and the bottom item urged towards the entry point when the second reading is a single media reading.

5. The method of claim 1, wherein (iv) further includes rotating, by the double feed recovery manager, the advance drive in the first direction to separate the media into a top item and a bottom item with the top item urged towards the exit point and the bottom item urged towards the entry point when the third reading is a single media reading.

6. The method of claim 1, wherein continuing any current processing further includes restoring, by the double feed recovery manager, the saved pressure pinch within the media separator module from the non-transitory computer-readable medium and restarting the media separator module after the configured period of time.

* * * * *